United States Patent [19]

Wünnenberg et al.

[11] 4,171,719

[45] Oct. 23, 1979

[54] APPARATUS FOR INSPECTING THE TAPER OF CONTINUOUS CASTING MOLDS

[75] Inventors: Klaus Wünnenberg, Duisburg; Joachim Dubendorff, Krefeld, both of Fed. Rep. of Germany

[73] Assignee: Mannesmann Aktiengesellschaft, Düsseldorf, Fed. Rep. of Germany

[21] Appl. No.: 845,889

[22] Filed: Oct. 27, 1977

[30] Foreign Application Priority Data

Oct. 28, 1976 [DE] Fed. Rep. of Germany ..... 2649497

[51] Int. Cl.[2] ..... B22D 11/16

[52] U.S. Cl. ..... 164/150; 164/436; 164/4

[58] Field of Search ..... 164/4, 150, 154, 413, 164/435, 436

[56] References Cited

U.S. PATENT DOCUMENTS

| | | | |
|---|---|---|---|
| 3,292,216 | 12/1966 | Colombo | 164/435 |
| 3,338,295 | 8/1967 | Scribner | 164/413 X |
| 3,375,865 | 4/1968 | Boichenko et al. | 164/436 |
| 3,964,727 | 6/1976 | Gladwin | 164/436 X |

*Primary Examiner*—Robert D. Baldwin
*Assistant Examiner*—K. Y. Lin
*Attorney, Agent, or Firm*—Smyth, Pavitt, Siegemund, Jones & Martella

[57] ABSTRACT

An individually adjustable wall plate of a mold for continuously casting is connected to a transducer in the rear to indicate the effective tilt angle. A one transducer system includes two transducer elements being supported in different vertical levels; a two transducer system includes vertically spaced, displaceable transducer elements and stationary reference elements.

4 Claims, 3 Drawing Figures

APPARATUS FOR INSPECTING THE TAPER OF CONTINUOUS CASTING MOLDS

BACKGROUND OF THE INVENTION

The present invention relates to the inspection of the taper of the walls in a mold for continuous casting.

Molds for continuous casting of slab ingots are frequently constructed from individual plates which are mounted in a manner which permits adjustment of the dimensions of the mold cavity. The French Pat. No. 1,388,653 is representative of the state of the art of such molds, particularly as to the feature of providing each mold with a particular taper in down direction. The taper is adjusted by means of spindles, and the adjustment depends on the relative width-to height-to depth relation of the mold, on the brand or grade of steel and on the casting and ingot withdrawal speed. Choice of the proper taper is quite important and rather critical on the small sides of the mold. The ingot as cast tends to shrink particularly because the temperature drops generally in the direction of casting, and shrinkage along the long, traverse axes of the slab (in cross-section) is more pronounced than along the short axes.

It follows from the foregoing, that the taper of the mold wall plates has to be adjusted individually. One uses here a reference which is established by a plumb line (plummet, plumb bob, or the like) in order to ascertain the horizontal displacement of the lower edge from a vertical plane through the upper edge (or vice versa) of the wall. It was found that this kind of measurement is not too reliable and rather cumbersome. Other methods are known to measure the taper of a mold walls by scanning its inner surface.

The known methods for ascertaining the actual taper of a wall of a mold have the disadvantage that they require an empty mold, i.e. they can be practiced only when casting is not in progress. This reduces further the overall duty cycle time of a casting machine.

Investigations have shown that particularly the broad side walls of a mold for continuously casting slab ingots undergo a certain expansion which results in an uncontrolled displacement of the small sides, particularly under reduction of the taper thereof. This effect has been explained as being due to irregular expansion of different parts of a mold wall due to differences in thermal load. Since the parameters and conditions of casting remain the same otherwise, this change in taper has a detrimental effect on the quality of the cast ingot. Actually, the skin may even rupture due to such taper changes during casting.

DESCRIPTION OF THE INVENTION

It is an object of the present invention to avoid the difficulties and problems outlined above and to provide a new and improved method and equipment for inspecting the taper of mold walls during continuous casting. The invention is also concerned with steps to be taken during casting to remedy the effect of any change in the taper.

In accordance with the preferred embodiment of the present invention, it is suggested to establish a reference position in the rear of a mold wall, the wall and its immediate support being mounted for tilting and positioning to assume a particular taper and tilt with reference to the interior of the mold in the direction of continuous casting. Displacement detector means are connected to a rear portion of that mold wall and its horizontal displacement relative to that reference position is ascertained and used as a measure that indicates tilt and taper of the mold wall. This indication can be provided during casting, and the taper can readily be corrected if correction is needed. Ultimately, the casting withdrawal speed can be modified on the basis of a detected change in taper and tilt angle.

The reference position can be established mechanically or electrically, and with respect to the mold wall itself or to a stationary part. In the case of defining the reference position in relation to the mold wall, the reference position moves with horizontal displacement of the wall other than tilting.

DESCRIPTION OF THE DRAWINGS

Proceeding now to the detailed description of the drawings, FIG. 1 shows a long or wide side wall 8 of a mold for continuous casting and from the inside of the mold cavity. The wall 8 is mounted on a lifting table and frame 7. The opposite mold wall is denoted by 8' in FIG. 2. In addition, FIGS. 1 and 2 show a small side wall 3, being shown in cross-section in FIG. 1 and being mounted on a frame or back plate 6. Wall 3 has water ducts for cooling, and the back plate 6 is provided with feed-in and discharge ducts for the cooling water.

Figure 1:
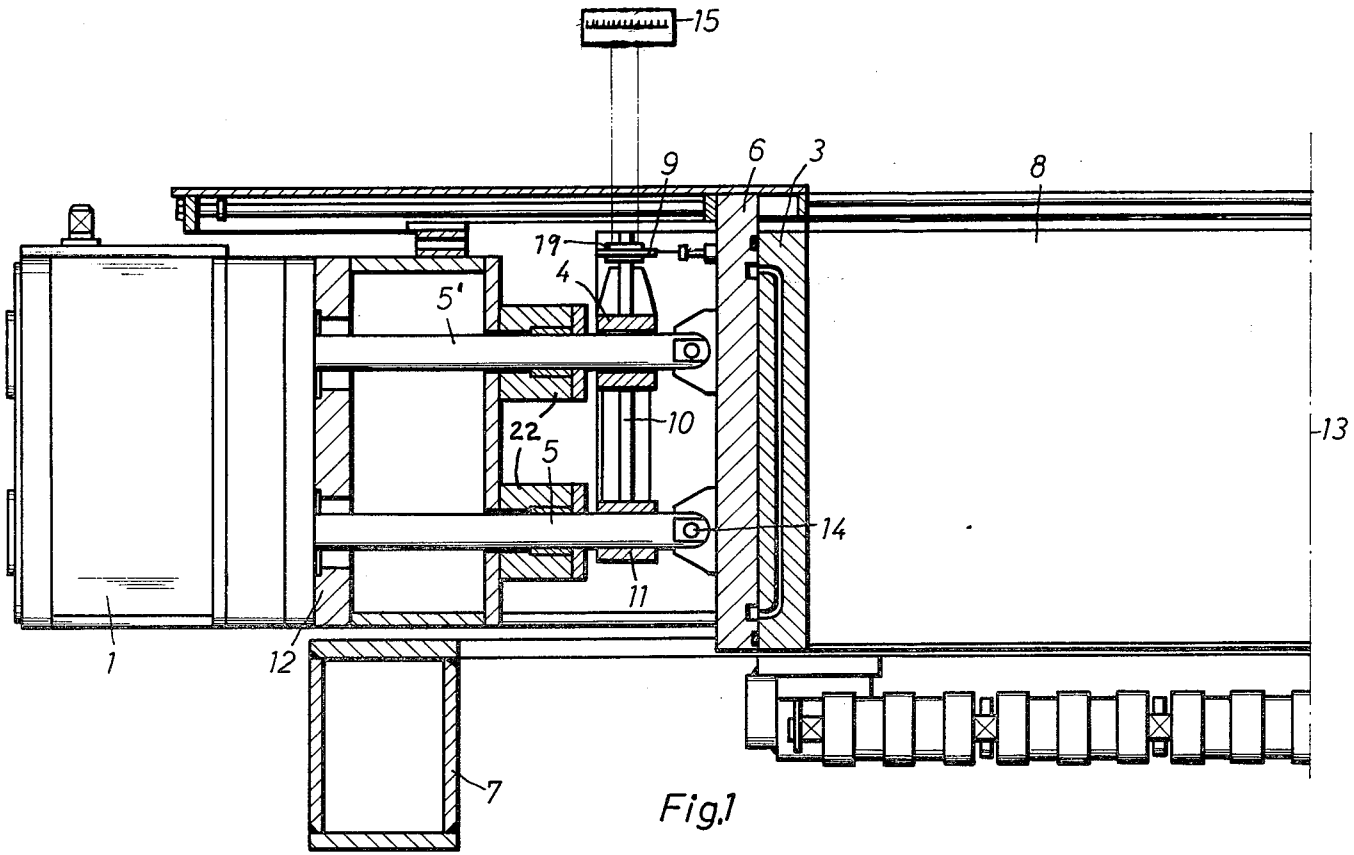
FIG. 1 is a side and section view through a portion of a mold for continuous casting of slab ingots.

Reference numeral 2 refers to the casting stand and a frame generally in which is mounted a support structure 12 with bearing and guide elements 22 receiving spindles 5 and 5'. The spindles 5, 5' are threaded only to the extent needed for being driven axially (without turning) by a gear and drive unit 1 which is also mounted to stand and frame 2.

The back plate 6 for side wall 3 is pivotally linked to the front end of the spindles 5, 5' which hold the back plate and the wall 3 but permit also adjustment of the position and orientation of the wall 3 generally including adjustment towards particular deviation from a true vertical orientation. Presently it is assumed that the spindle 5 determines primarily the position of the wall structure 6, 3 while spindle 5' follows that positioning and determines additionally the tilt angle of the wall plates 3, 6 by pivoting the like on the pivot axis 14.

The lower spindle 5 carries a support element 11 being secured thereon. A reference arm 10 extends upright from that support element and carries a sleeve 4 being slidingly traversed by spindle 5'. The arm 10 extends higher than the sleeve 4 and carries on its top a transducer coil 19, having a particular, well-known distance from the center axis of support sleeve 11 being also the axis of the spindle 5. The coil 19 establishes the reference position needed to ascertain the tilt of the wall. It should be noted that the axis of spindle 5 traverses also the pivot axis 14 on which spindle 5 is pivotally linked to back plate 6. The arm 10 can also be regarded as establishing a vertical reference plane; for example, a plane through the axis of arm 10 and at right angles to the axis of spindle 5 will serve as such a reference plane. By virtue of fixing element 11 to spindle 5, a fixed distance of that reference plane or of the coil 19 to the wall 3 and in a horizontal direction is established.

A feeler arm or core 9 has a variable position in coil 19, and is linked to the upper position of the back plate 6. The depth of insertion of core arm 9 in coil 19 determines the distance of reference point (coil 19) from the back plate 6. The device 9/19 generally constitutes a position responsive transducer by means of which the displacement of the upper portion of mold wall 3 relative to the reference plane or reference position is ascertained. That transducer can be of any known construction, having as principle function the capability of detecting the distance of plate 6 from the point of intersection of the horizontal axis of the displaceable element, e.g. 9, with the reference plane as defined by post or arm 10.

Reference numeral 15 denotes the indicating part and/or evaluating unit that signals the output of the transducer 9,19. Considering the connection, it can readily be seen that the transducer elements 9 and 19 are connected particularly to different, vertically spaced, rear points of the mold wall in a manner so that any horizontal displacement of the elements in relation to each other establishes directly an indication of mold wall tilting and taper, independent from the forward position of the wall. Either transducer element can be regarded as defining a reference position, and the other one of them being displaced relative thereto. Speaking broadly, one may dispense with the definition of a particular location for a vertical reference plane or position, and consider only the electrical output of the transducer 9, 19. Nevertheless, the transducer elements do establish particular mutual positions, and one of them can always be regarded as a reference position. Any specific output of the transducer defines a tilt angle and taper of the wall and plate configuration 3, 6.

Initially, the equipment is adjusted in that the position of plate 6 with mold wall 3 is placed into a true vertical orientation as far as the inner surface of wall plate 3 is concerned. The spindles 5, 5' are adjusted accordingly. The output of the transducer 9/19, whatever its value becomes the zero and electrical reference point. In addition, the instrument could be calibrated to correlate signal outputs and various angles of inclination and tilts for the wall plate 3 corresponding to various mold wall tapers. The mold wall is also adjusted to assume a particular position and orientation in preparation of casting. As casting begins, instrument 15 yields a running indication as to the inclination of the wall structure 3, 6. Any deviation from the normal or desired taper can immediately be remedied by advancing or retracting spindle 5'. Alternatively, the casting speed and ingot withdrawal speed can be changed as that may be a more appropriate remedy for the taper deviation that was detected.

Figure 2:
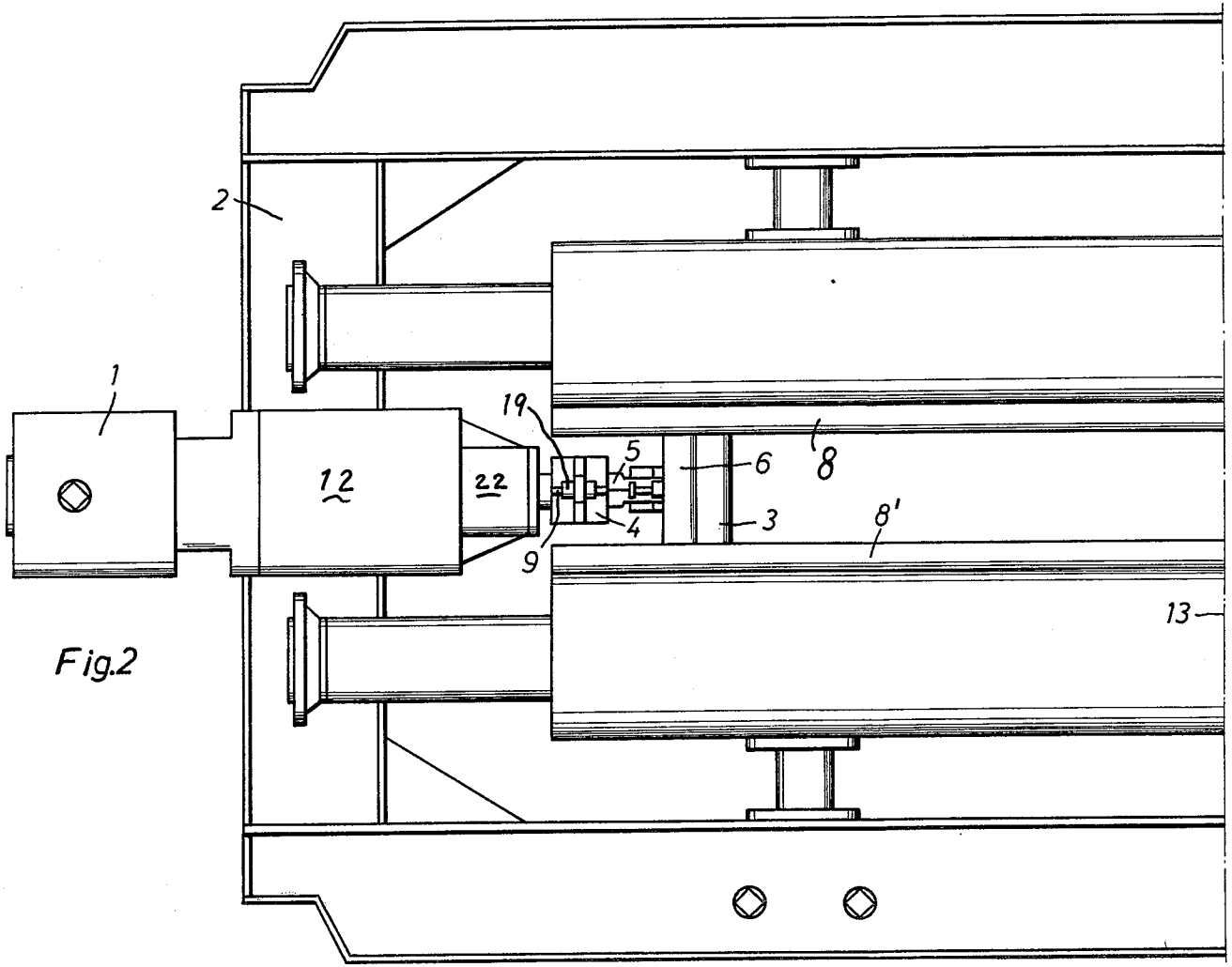
FIG. 2 is a top view of that portion of the mold as depicted in FIG. 1.
Figure 3:
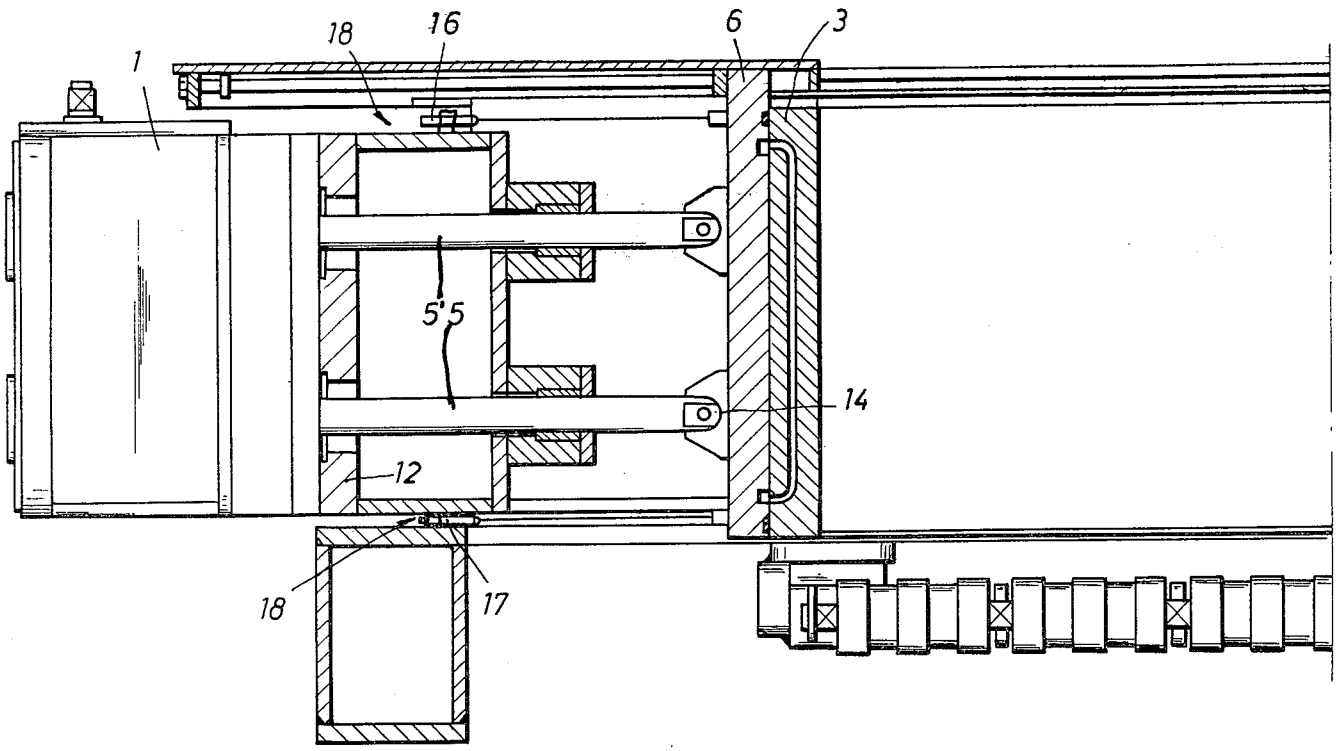
FIG. 3 is a view similar to FIG. 1, but showing certain modifications.

The apparatus as shown in FIG. 3 is similar in many respects to the apparatus as shown in FIGS. 1 and 2. This concerns particularly the mold wall and frame structure as well as the spindles with their drive and support. Unlike FIGS. 1 and 2, however, there is no mechanical reference on lower spindle 5. Rather, there is provided an upper and a lower inductive transducer 16 and 17 respectively, whose stationary parts are mounted to support structure 12. A vertical orientation of plates 3, 6 produces particular outputs, i.e. a particular signal differential of the two transducers, and any deviation of that differential is indicative of a tilt and taper.

This example can be interpreted as follows. Both transducers have a pair of relatively displaceable elements, and the position of the respective fixed elements can be regarded as defining mechanically reference positions for forward position and tilt. The movable element of one of the transducer elements in conjunction with the element fixed to stand part 12 can then be regarded as defining a corrective reference value which, in conjunction with the stationary position of the fixed element of the other transducer, establishes the reference position for the tilt.

Finally, one can eliminate also here specifies of a hypothetical reference plane (though it always can be defined) and consider only the electrical outputs of the transducers in relation to each other. Conceivably, they may be connected to a difference-forming network. Any difference signal defines a particular tilt angle of the mold wall and plate configuration 3, 6 in relation to any suitable hypothetical reference plane which may be helpful for determining that tilt angle and taper.

Conceivably, transducer 17 would be omitted, and initial calibration uses transducer 11 alone. That, however, presupposes that during operation spindle 5 never changes position. In that case, one has only a fixed reference established by mounting one transducer element of transducer 16 to support structure 1.

The invention is not limited to the embodiments described above but all changes and modifications thereof not constituting departures from the spirit and scope of the invention are intended to be included.

We claim:

1. In a mold for continuous casting of slab ingots having individually positionable in orientable side walls defining a mold cavity being open at the bottom, the combination comprising:

two vertically aligned adjusting spindles connected for orienting and positioning one of the side walls, the spindles being pivotally linked to the rear of the said side wall, an arm mounted on one of the spindles extending vertically at right angles therefrom, the arm holding a first transducer element; and a second transducer element coupled to the rear of the side wall at a point vertically remote from a point in that the one spindle is linked to the side wall, the first and second transducer elements coacting to provide a signal being indicative of a horizontal displacement of one transducer element to the other one in representation of the mold wall taper.

2. In a mold for continuous casting of slab ingots having individually positionable and orientable side walls defining a mold cavity being open at the bottom, the mold further including, for at least one side wall, means for positioning and tilting the side wall, an apparatus for indicating the taper or tilt of the side wall, comprising:

a first transducer element particularly connected to a part near or close to the bottom of the rear of the mold plate; and a second transducer element connected to a point near or close to the top of the rear of the mold plate, one of the transducer elements establishing a vertical reference position in a particular vertical level to the rear of the side wall opposite the surface facing the mold cavity, the transducer elements coacting for ascertaining a relative displacement of the side wall from said reference position in horizontal direction and in representation of the mold wall taper.

3. In a mold for continuous casting of slab ingots having individually positionable and orientable side walls defining a mold cavity being open at the bottom, the mold further including, for at least one side wall, means for positioning and tilting the side wall, an apparatus for indicating the taper or tilt of the side wall, comprising:

at least a first one transducer element being stationarily mounted;

a second transducer element connected to the mold plate, the relative position of the two elements to each other being indicative of the position mold plate in level as defined by the first and second transducer elements;

a third transducer element being stationarily mounted and vertically displaced from the first transducer element; and a fourth transducer element connected to the mold plate vertically displaced from a point of connection of the second element to the plate, the position of the third and fourth elements in relation to each other being a particular indication, the differential of the position indications of the first to the second and of the third to the fourth element indicating relative tilt of the plate.

4. In a mold for continuous casting of slab ingots having individually positionable and tiltable side walls defining a mold cavity being open at the bottom, the mold further including, for at least one side wall, means for positioning and tilting the side wall, an apparatus for indicating the taper or tilt of the side wall, comprising:

a first transducer element disposed in the rear of and connected to the side wall and being displaced upon a change in tilt angle and taper of the side wall;

a second transducer element coacting with the first element and establishing a reference position in relation to which the first transducer element is displaced;

a third transducer element being stationarily mounted and vertically displaced from the first transducer element; and a fourth transducer element connected to the mold plate vertically displaced from a point of connection of the second element to the plate, the relative position of the third and fourth elements being a particular indiation, the differential of the position indications of the first to the second and of the third to the fourth element indicating relative tilt of the plate.

* * * * *